US010787347B1

(12) United States Patent
Gurule

(10) Patent No.: US 10,787,347 B1
(45) Date of Patent: Sep. 29, 2020

(54) SELF-LOCKING PULLEY

(71) Applicant: Randy Gurule, Grand Terrace, CA (US)

(72) Inventor: Randy Gurule, Grand Terrace, CA (US)

( * ) Notice: Subject to any disclaimer, the term of this patent is extended or adjusted under 35 U.S.C. 154(b) by 63 days.

(21) Appl. No.: 16/291,187

(22) Filed: Mar. 4, 2019

(51) Int. Cl.
*B66D 3/10* (2006.01)
*B66D 5/16* (2006.01)
*B66D 3/08* (2006.01)

(52) U.S. Cl.
CPC ..... *B66D 3/10* (2013.01); *B66D 3/08* (2013.01); *B66D 5/16* (2013.01)

(58) Field of Classification Search
CPC ..... B66D 1/7489; B66D 1/7473; E04G 21/3204; A63B 29/024; A63B 29/028; A62B 1/08; A62B 1/10; A62B 1/14
USPC ..... 254/391, 394
See application file for complete search history.

(56) References Cited

U.S. PATENT DOCUMENTS 2,136,014 A 11/1936 McDonnald
3,112,816 A * 12/1963 Halford ..... B66D 3/10 254/391
4,120,077 A 10/1978 Kink
4,264,056 A * 4/1981 Singer ..... B66D 3/10 24/127
4,910,834 A 3/1990 Minkler
5,146,655 A 9/1992 Gibbs
5,615,865 A * 4/1997 Fountain ..... B66D 3/10 254/269
5,845,893 A * 12/1998 Groves ..... B63B 21/50 254/389
6,412,602 B1 * 7/2002 Sundman ..... A62B 1/14 182/133
6,685,171 B2 2/2004 Lob et al.
7,752,719 B2 7/2010 Howard
7,798,472 B2 * 9/2010 Vankeuren, II ..... B66D 3/18 254/278
9,427,606 B2 * 8/2016 Ball ..... B66D 1/7447
9,604,087 B2 3/2017 Brown et al.
9,790,064 B2 * 10/2017 Timmermans ..... A63B 29/00
2003/0034203 A1 * 2/2003 Hewlett ..... A62B 1/14 182/5
2007/0000737 A1 * 1/2007 Bamberg ..... A62B 1/14 188/65.4
2008/0203371 A1 * 8/2008 Mauthner ..... B66D 3/08 254/391

(Continued)

*Primary Examiner* — Emmanuel M Marcelo
(74) *Attorney, Agent, or Firm* — Kirk A. Buhler; Buhler & Associates Patenting

(57) ABSTRACT

Improvements to a pulley is disclosed. The rope is threaded through the self-locking pulley in the desired direction. At some places, the threading passes the rope or strap in opposing directions to cause a binding and prevent free movement of the rope or strap in one direction. There are no one-way clutches or self-locking teeth to lock movement in a particular direction. A first part it secured to a spinning mount or ceiling so a user can walk around a suspended self-locking pulley and pull the rope or strap from any direction. The second part can pivot and move up-and-down on the first piece. A threaded member alters a frictional lock between the at least two interconnecting pieces. The interaction of the at least two pieces allows for lifting, locking and lowering of a load on the rope or strap.

17 Claims, 5 Drawing Sheets

(56) References Cited

U.S. PATENT DOCUMENTS

| | | | | |
|---|---|---|---|---|
| 2009/0120720 | A1* | 5/2009 | Arms | A62B 1/14 182/193 |
| 2010/0116588 | A1* | 5/2010 | Bamberg | A63B 29/02 182/5 |
| 2011/0068311 | A1* | 3/2011 | Rogelja | B66D 3/06 254/391 |
| 2011/0168961 | A1* | 7/2011 | Christiansen | B66D 1/00 254/327 |
| 2011/0315480 | A1* | 12/2011 | Maurice | A62B 1/14 182/193 |
| 2013/0180800 | A1* | 7/2013 | Mauthner | A62B 1/14 182/5 |
| 2015/0183624 | A1* | 7/2015 | Maurice | B66D 3/046 254/399 |
| 2016/0228730 | A1* | 8/2016 | Chaumontet | A63B 29/02 |
| 2017/0001055 | A1* | 1/2017 | Brown | A63B 29/02 |
| 2019/0351264 | A1* | 11/2019 | Ratalino | A62B 1/14 |

* cited by examiner

SELF-LOCKING PULLEY

CROSS REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a locking pulley is disclosed. The self-locking pulley allows a rope or strap to loop through the pulley where the pulley locks the rope or strap from movement through the pulley, but is easily pulled through the pulley.

Description of Related Art Including Information Disclosed Under 37 CFR 1.97 and 1.98

The need to lift and hold a load has been needed for as long as ropes or straps have been used. There have been a variety of systems and methods that have been invented over years. Most of these systems use knots or pinching mechanism to hold the rope or strap. A number of patents and or publications have been made to address these issues. In the cases of knots or pinching mechanisms a user must be able to manually loosen the knot or pinching mechanism. Exemplary examples of patents and or publication that try to address this/these problem(s) are identified and discussed below.

U.S. Pat. No. 4,120,077 was issued on Oct. 17, 1978 to William F. Fink and is titled Tie-Down Tensioning Device. This patent discloses a device for use in tensioning the lines, ropes or cables used to tie down cargo during transport aboard a ship or other means of transportation is disclosed. An embodiment of the device is described which comprises a rigid body defining an open ended, open top channel tapering from minimum transverse dimensions at the bottom to larger transverse dimensions at the open top thereof with a hook rigidly fixed to the body at one end of the channel, a bracket rigidly fixed to the body at the other end of the channel and an opening through the body at one end of the channel having cross-sectional dimensions larger than the minimum transverse dimensions of the channel. While this patent discloses a rope pulley system it uses binding teeth to retain the rope.

U.S. Pat. No. 4,910,834 was issued on Mar. 27, 1990 to Donald W. Minkler and is titled Tie-Down Tensioning Device. This patent discloses a quick connect adjusting loop for a cargo tie-down rope comprises a body of substantially rigid, high strength material having a first portion forming a loop through which a loop of a tie-down rope extends and a second portion forming slip lock adjacent the loop for releasably gripping the rope. While this patent is for use with a rope it only operates in one-direction and must be untied to release the tension on the rope.

U.S. Pat. No. 6,685,171 was issued on Feb. 3, 2004 to Charles j. Lob et al., and is titled Lifting Device. This patent discloses a lifting device comprises a rotatable pawl with a pawl arm held in a pawl sleeve. The pawl has an open position in which a rope may be freely adjusted in tightening or loosening directions, and a closed position in which the rope is lockably engaged between the pawl and the pawl sleeve. The pawl has a pawl arm against which the locked rope may be directed to rotate the pawl into an open position. While this patent is for a lifting device, it requires a person to open the pawl, and if the lifting device is elevated it may be difficult to release the rope.

U.S. Pat. No. 9,604,087 was issued on Mar. 28, 2017 to Christopher Brown et al., and is titled Rope Climbing Systems and Methods of Use. This patent discloses Various apparatuses for rope-climbing and associated methods are provided. Embodiments include a circular loop of rope and a variable braking system allowing for a freely suspended rope-climbing experience a safe distance from the ground and at a speed variable to individual users. This patent is essentially for a person to continuously climb a rope and is not a releasable lifting system.

What is needed is a locking pully that can be released from any direction by altering the angle between the pinching plates. The proposed self-locking pulley disclosed in this document provides the solution.

BRIEF SUMMARY OF THE INVENTION

It is an object of the self-locking pulley to hold a rope or strap at a desired level of elevation. This allows a person to pull on a rope or strap that elevates a load. When the load reaches the desired height, releasing the rope or strap will self-lock the load at the height.

It is an object of the self-locking pulley to accommodate a variety of ropes with different diameters. The rope or strap is threaded through the locking pulley in the desired direction. At some places, the threading passes the rope or strap in opposing directions to cause a binding and prevent free movement of the rope or strap in one direction.

It is another object of the self-locking pulley to have a variety of pulleys that allows free movement of the rope or strap around the pulleys. There are no one-way clutches to lock movement in a particular direction. There are no locking teeth that binds the rope, nor a clutch or a cam that pinches the rope.

It is another object of the self-locking pulley to be fabricated with at least two interconnected pieces. A first piece is secured to a mount or ceiling. The second part can pivot and move up-and-down on the first piece. A threaded member alters a frictional lock between the at least two interconnecting pieces. The interaction of the at least two pieces allows for lifting, locking and lowering of a load on the rope or strap.

It is still another object of the self-locking pulley to include a spinning connection at one end of the locking pulley. The spinning connection allows a user to walk around a suspended locking pulley and pull the rope or strap from any direction. This does not restrict use from pulling the rope or strap in a particular direction.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
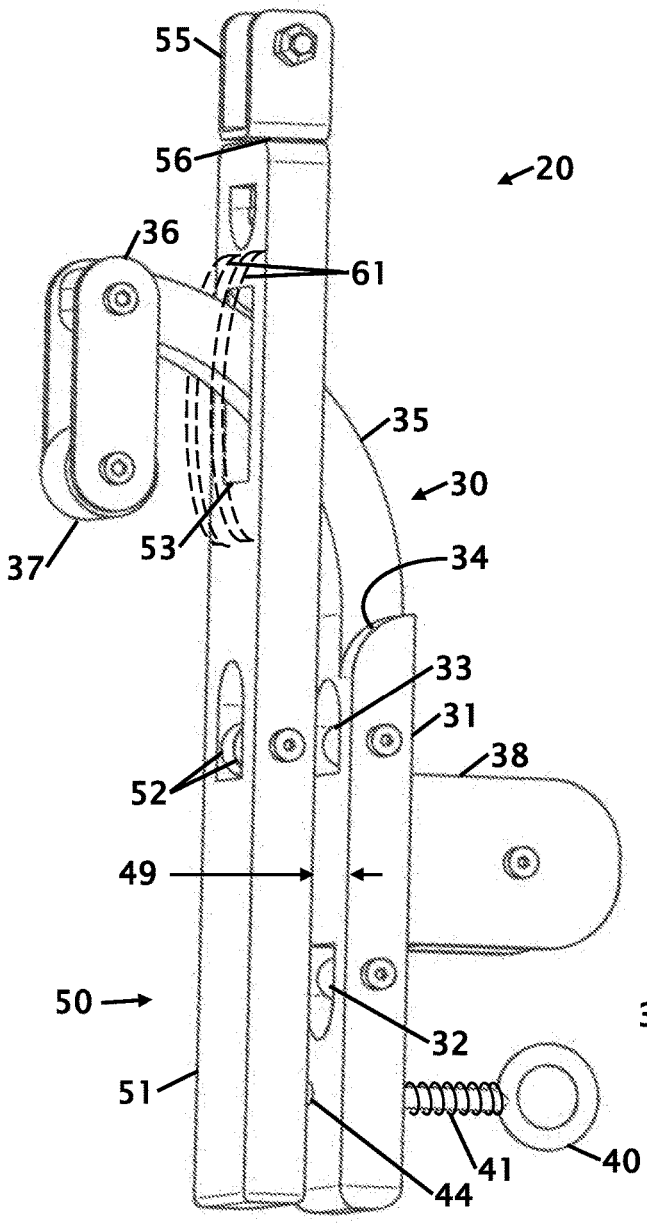
FIG. 1 shows a front perspective view of a self-locking pulley.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

ITEM NUMBERS AND DESCRIPTION

Figure 2:
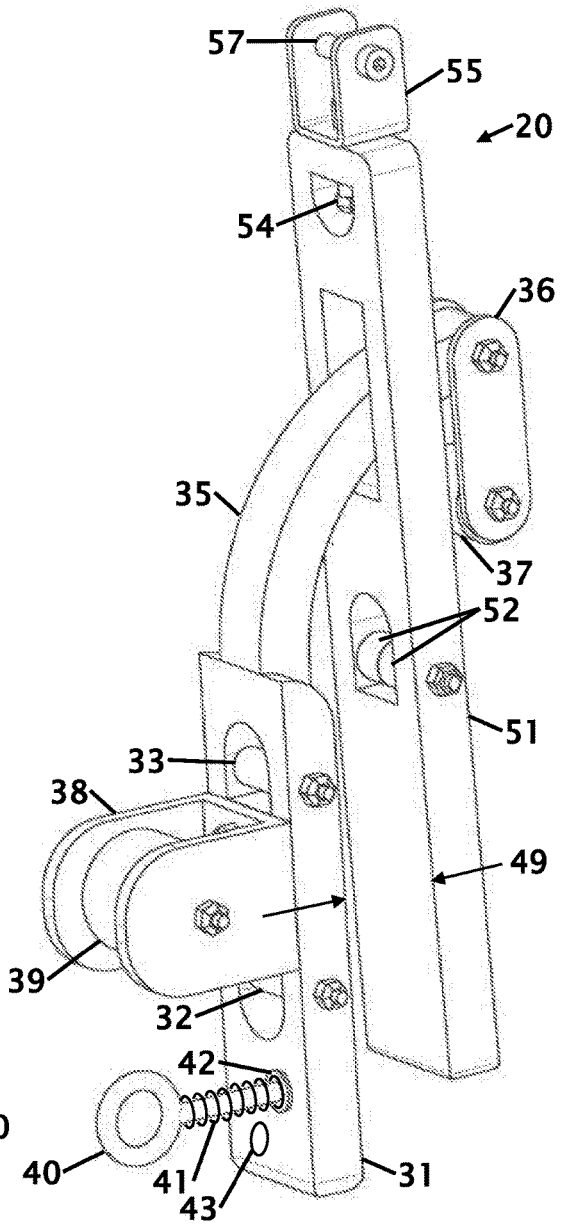
FIG. 2 shows a rear perspective view of the self-locking pulley.

20 self-locking pulley
30 moving pulley
31 moving bar
32 roller
33 roller
34 curved shoulders
35 bent arm
36 side plates
37 roller
38 horizontal bracket
39 horizontal roller
40 control unlocking eye bolt
41 compression spring
42 washer
43 tapped hole
44 threaded portion
49 opening
50 fixed pulley
51 fixed bar
52 two rollers
53 opening
54 self-locking nuts
55 "U" bracket
56 bolt
57 shoulder bolt
58 friction pad
59 radiused side
60 radiused side
61 reinforcing ribs
89 rope
90 first placed
91 threaded
92 through
93 over
94 down
95 passed through
96 passes
97 pass
98 pulling down
99 loose direction FIG. 1 shows a front perspective view of a self-locking pulley 20 and FIG. 2 shows a rear perspective view of the self-locking pulley 20. The self-locking pulley 20 is made from two essential parts, the moving pulley 30 and the fixed pulley 50. The body of the frame for these pieces is made from aluminum, but other materials are contemplated. The fixed pulley 50 is a fixed bar 51 with an opening 53 where the moving pulley 30 passes through the opening 53 to control the rope or strap (rope or strap not shown in these figures).

The bar 51 has an opening where two rollers 52 are placed side-by-side. The use of two rollers 52 allow rope or strap to pass and roll in opposite directions through the opening where the pulleys are used. The top of the fixed bar 51 has a "U" bracket 55 that is secured with a bolt and self-locking nuts 54 on a bolt 56. This allows the fixed bar 51 to freely turn and a user can lift, lock and release a load from any direction. The "U" bracket 55 has a cross shoulder bolt 57 for securing the self-locking pulley 20 in an overhead arrangement. While the self-locking pulley 20 is intended for an overhead use, it is contemplated that the self-locking pulley 20 can be used in other orientations. It is contemplated that reinforcing ribs 61 can be incorporated into the fixed bar 51 to increase the strength around the opening 53.

The moving pully 30 has a moving bar 31 with a bent arm 35 that is bent to fit through the opening 53 in the fixed bar 51. The bent arm 35 is square or rectangular in cross-section to prevent or minimize rotation of the bent arm 35 in the opening 53 in the fixed bar. The side plates 36 are held onto the bent arm 35 with a shoulder bolt or other fastener. An overhead roller 37 or pully is retained with a shoulder bolt or other fastener to the side plates. The roller 37 or pully allows a rope to pass through the opening between the side plates. The addition of the side plates 36 on the bent arm 35 prevents the moving bar 31 from being drawn through the opening 49.

A pair of curved shoulders 34 are on the sides of the bent arm where the bent arm joins to the body of the moving bar 31. The back of the moving bar 31 has a horizontal roller 39. Secured to another "U" horizontal bracket 38. There are openings and rollers 32 and 33 for the rope or strap to pass through the moving bar 31.

The moving bar 31 includes an adjustment that sets the distance between the moving bar 31 and the fixed bar 51. In the embodiment shown, the adjustment is with an control unlocking eye bolt 40. The control unlocking eye bolt 40 is threaded into the moving bar 31. A compression spring 41 and washer 42 is secured with the control unlocking eye bolt 40. Adjustment of the control unlocking eye bolt 40 changes the amount of exposure of the threaded portion 44 of the control unlocking eye bolt 40. This sets or adjusts the gap between the two plates and the amount of pressure on the rope or strap. A smaller diameter rope or strap will have a smaller gap, while a larger diameter rope or strap will have a larger gap. An alternate tapped hole 43 is placed at an angle through the moving bar 31. The tapped hole 43 is an alternate embodiment for the control unlocking eye bolt 40 to allow for adjustment of the gap between the plates of the self-locking pulley 20 from under the self-locking pulley 20.

Figure 3:
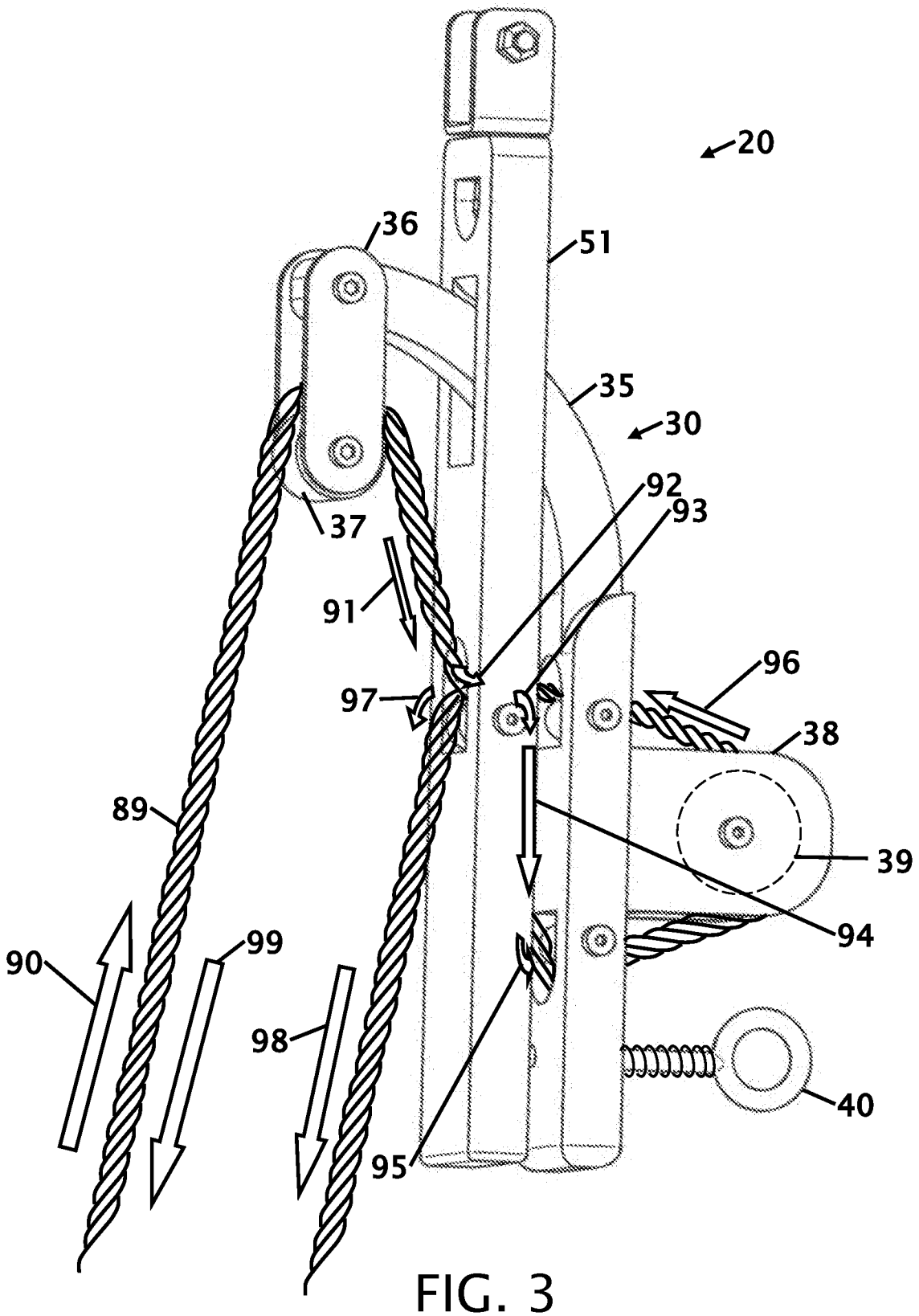
FIG. 3 shows a rope threaded through the self-locking pulley.

FIG. 3 shows a rope threaded through the self-locking pulley 20. The rope 89 can be threaded through the self-locking pulley 20 in either direction. In this example, the rope 89 is first placed 90 through the overhead pully or roller 37 that is held by side plates 36 on the bent arm 35 of the moving bar 31. The rope 89 is then threaded 91 down and through 92 the opening that has the two rollers 52. The rope 89 is then threaded over 93 and down 94 between the moving pulley 30 bar 31 and the fixed bar 51. The rope 89 is then passed through 95 the under roller 32. The rope 89 then changes direction and is wrapped over the horizontal roller 39 that is held on the horizontal bracket 38. While a rope 89 is shown in some of the figures it should be equally understood that a strap could equally be used in the self-locking pulley 20.

The rope 89 is then passes 96 through the over roller 33 and then over the other two roller 52. This allows each of the two roller 52 to spin in opposite directions. The rope will then pass 97 downward. Pulling down 98 will lock the rope 89 in the self-locking pulley 20, while pulling on the rope 89 with allow the rope 89 to be pulled through the self-locking pulley 20.

Figure 4:
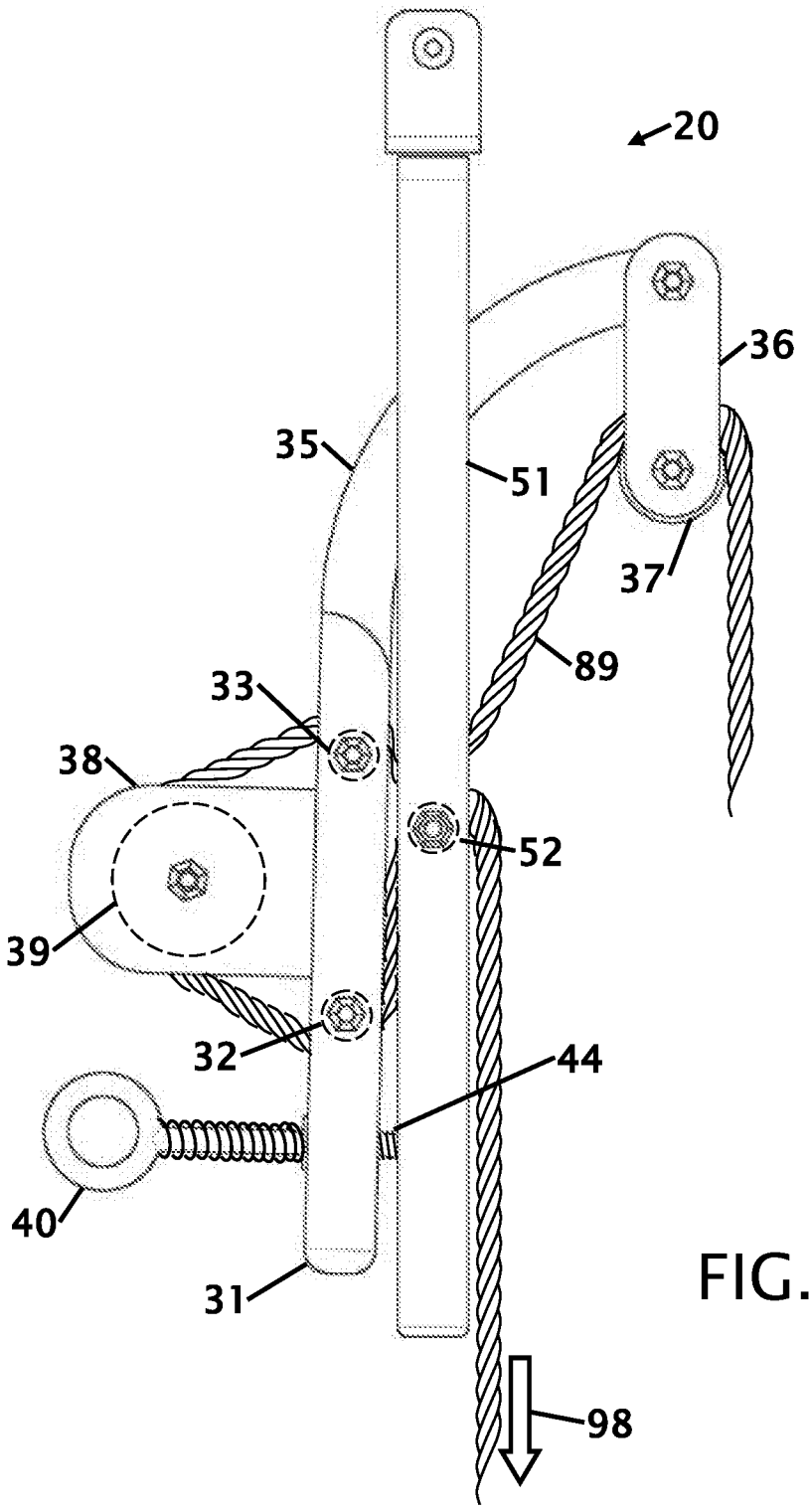
FIG. 4 shows a left view of the self-locking pulley with a rope or strap being pulled in a locking direction.

FIG. 4 shows a left view of the self-locking pulley 20 with a rope 89 being pulled down 98 in a locking direction. When the rope 89 is pulled down 98, as shown in this figure the tension on the rope 89 pulls the moving bar 31 against the fixed bar 51. This is accomplished by the rope 89 pulling on the horizontal roller 39 that pulls the moving bar 31 against the fixed bar 51 with the tension on both paths of the rope 89. The control unlocking eye bolt 40 is adjustable to change the extension of the threaded portion 44 between the moving bar 31 and fixed bar 51. This unlocks the amount that the rope is compressed between the moving bar 31 and fixed bar 51 to frictionally hold the rope 89.

Figure 5:
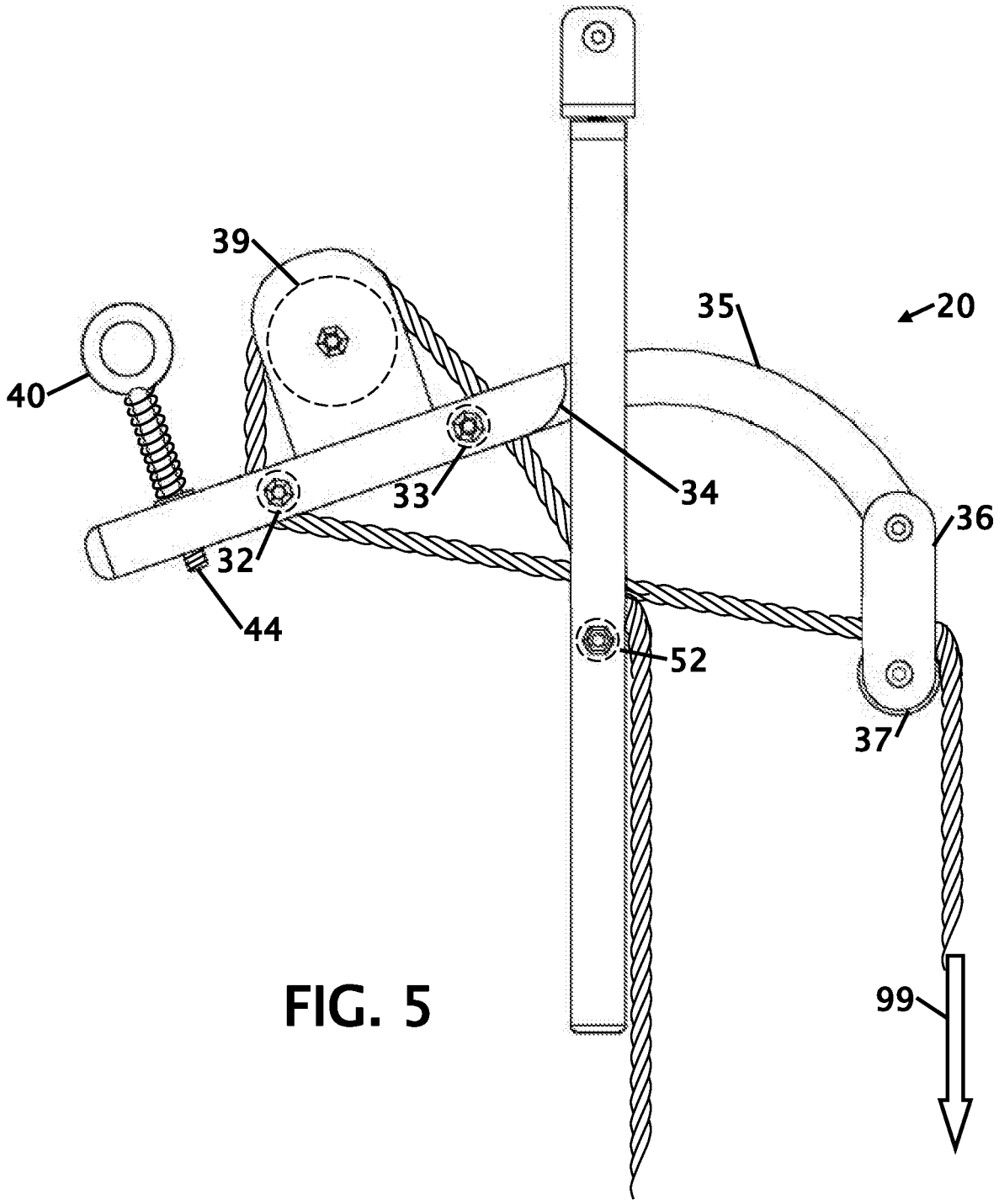
FIG. 5 shows a left view of the self-locking pulley with the rope or strap being pulled in a loose direction.

FIG. 5 shows a left view of the self-locking pulley 20 with the rope 89 being pulled in a loose direction 99. When the rope 89 is pulled in this direction 99, the tension in the rope lifts and rotates the moving bar 31 and the bent arm 35 is pulled into the opening 53. In this orientation, there are no pinching or clamping forces on the rope 89 between the fixed bar 51 and the moving bar 31. The rope 89 can then freely move around the pulleys and rollers 37, 52, 32, 39, 33 and 52 again. In both FIGS. 4 and 5 the side plates 36 and the overhead roller 37 can rotate from the bent arm 35. Any adjustment to the control unlocking eye bolt 40 and the eye bolt extension threaded portion 44 does not affect the movement of the rope 89.

Figure 6:
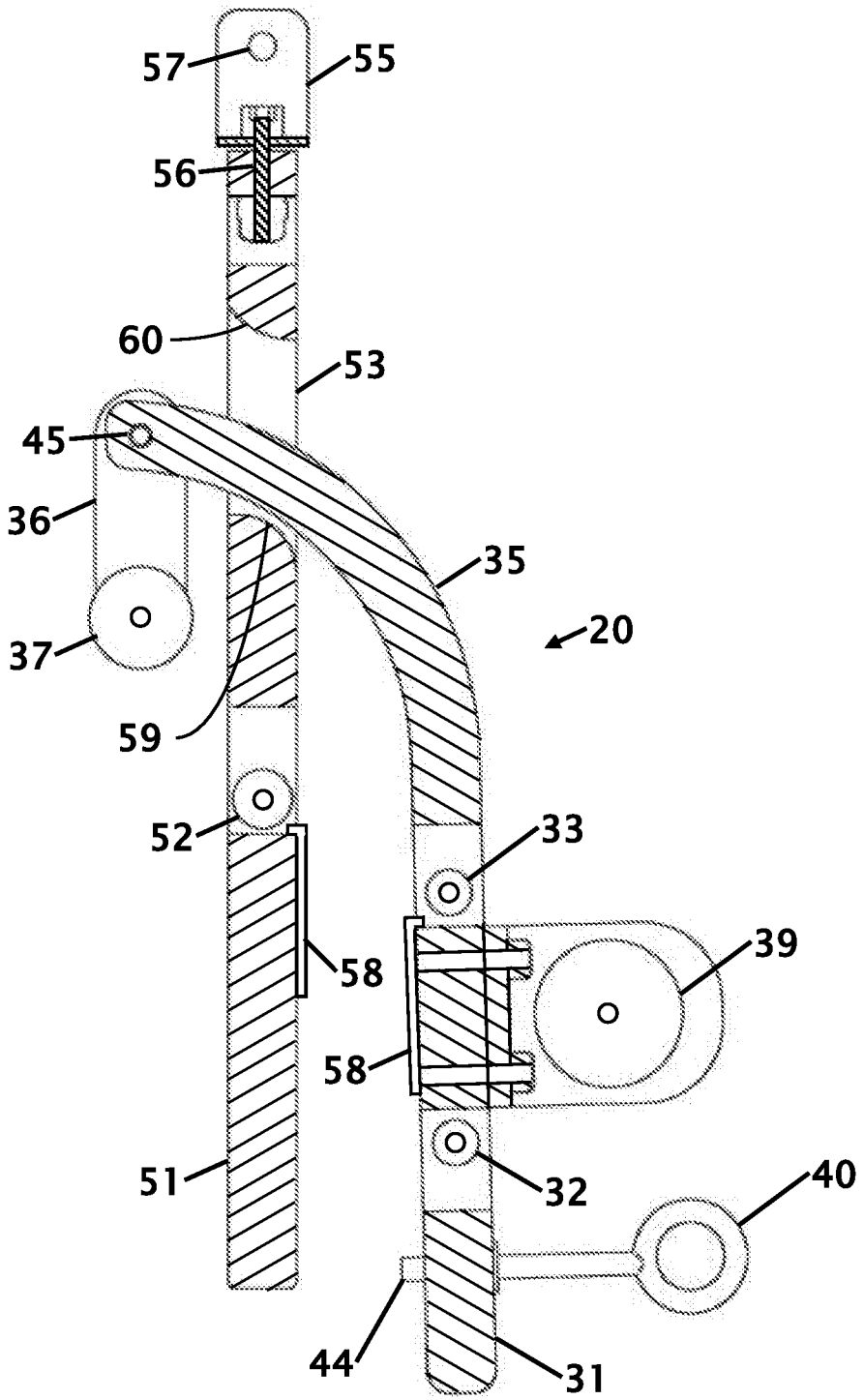
FIG. 6 shows a right view cross-sectional view of the self-locking pulley.

FIG. 6 shows a right view cross-sectional view of the self-locking pulley 20. This view shows the curved or radiused sides 59 and 60 of the opening 53 in the fixed bar 51. This reduces any frictional forces between the bent arm 35 in the opening 53 and further allows the bent arm 35 of the moving bar 31 to pivot within the opening 53. The rollers 32, 33 and 52 that allows the rope to pass, and move through the self-locking pulley 20 are shown. The overhead pulley or roller 37 is shows hanging on the side plates 36 through a pivot bolt 45. Roller 39 is shown secured and elevated or displaced from the back side of the moving bar 31.

In the top portion of this figure, the self-locking pulley 20 is shown suspended with a bolt 56 that holds the "U" channel 55 on the shoulder bolt 57. The control unlocking eye bolt 40 is further shown extending through the moving bar 31 with a threaded portion 44 on the other side of the moving bar 31. This figure also shows heat plates or friction pads 58 that are secured to the locking pulleys with fasteners or the like and are replaceable as they wear to prevent the sides of the locking pulley from wearing as the rope causes friction on these surfaces.

Thus, specific embodiments of a self-locking pulley have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A self-locking pulley comprising:

a fixed bar that is configured with a securing mechanism on an upper end;

a moving bar having a curved portion that extends through said fixed bar;

said moving bar having a roller suspended from a first end of said curved portion of said moving bar and said second end of said curved portion terminating in a straight section of said moving bar;

said moving bar further includes a plurality of rollers to guide a rope or strap through said straight section of said moving bar;

said fixed bar further includes an opening with at least two pulleys in a concentric alignment, and said moving bar includes an adjustment that adjusts a spacing between said fixed bar and said moving bar.

2. The self-locking pulley according to claim 1, wherein said securing mechanism on said upper end of said fixed bar pivots said securing mechanism on said fixed bar.

3. The self-locking pulley according to claim 1, further includes a "U" bracket secured to a top of said fixed bar.

4. The self-locking pulley according to claim 3, wherein said "U" bracket is configured to swivel on said fixed bar.

5. The self-locking pulley according to claim 4, wherein said swivel allows said self-locking pulley to be operated from any direction around said swivel.

6. The self-locking pulley according to claim 1, wherein said spacing in controlled by a threaded bolt.

7. The self-locking pulley according to claim 1, wherein said moving bar engages on said fixed bar on a radiused surface.

8. The self-locking pulley according to claim 1, wherein said curved portion of said moving bar passes through said fixed bar in an opening that has curved radiuses.

9. The self-locking pulley according to claim 1, further includes at least one friction pad between said moving bar and said fixed bar.

10. The self-locking pulley according to claim 1, wherein said fixed bar and said moving bar are made from aluminum.

11. The self-locking pulley according to claim 1, wherein said at least two pulleys rotate independent to each other.

12. The self-locking pulley according to claim 1, wherein said at least two pulleys are concentrically aligned.

13. The self-locking pulley according to claim 1, wherein said rope or strap is frictionally held between said fixed bar and said moving bar.

14. The self-locking pulley according to claim 1, does not use any one-way clutches.

15. The self-locking pulley according to claim 1, does not use a cam.

16. The self-locking pulley according to claim 1, does not use locking teeth.

17. The self-locking pulley according to claim 1, wherein said suspended roller pivots from said first end of said curved portion of said moving bar.

* * * * *